US008900413B2

(12) United States Patent
Yamada et al.

(10) Patent No.: US 8,900,413 B2
(45) Date of Patent: Dec. 2, 2014

(54) NONWOVEN FABRIC COMPRISING POLYPHENYLENE SULFIDE FIBER

(75) Inventors: Kenko Yamada, Otsu (JP); Satoshi Naruko, Otsu (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 13/819,263

(22) PCT Filed: Sep. 6, 2011

(86) PCT No.: PCT/JP2011/070239

§ 371 (c)(1),
(2), (4) Date: Apr. 12, 2013

(87) PCT Pub. No.: WO2012/033085

PCT Pub. Date: Mar. 15, 2012

(65) Prior Publication Data

US 2014/0144599 A1 May 29, 2014

(30) Foreign Application Priority Data

Sep. 7, 2010 (JP) ..... 2010-199559

(51) Int. Cl.
*D21F 11/00* (2006.01)

(52) U.S. Cl.
USPC ..... 162/138; 162/157.2

(58) Field of Classification Search
USPC ..... 162/138, 157.2, 146; 264/211.12; 428/212, 213; 442/239
See application file for complete search history.

(56) References Cited

U.S. PATENT DOCUMENTS

| | | | | |
|---|---|---|---|---|
| 2009/0253329 | A1* | 10/2009 | Shimizu et al. | 442/340 |
| 2010/0080959 | A1* | 4/2010 | Harvey et al. | 428/172 |
| 2010/0098991 | A1* | 4/2010 | Suzuki et al. | 429/30 |
| 2011/0114274 | A1* | 5/2011 | Takano et al. | 162/157.2 |

FOREIGN PATENT DOCUMENTS

| | | |
|---|---|---|
| JP | 61-289162 | 12/1986 |
| JP | 01-272899 | 10/1989 |
| JP | 03-137260 | 6/1991 |
| JP | 09-067786 | 3/1997 |
| JP | 2008-274518 | 11/2008 |
| JP | 2009-277653 | 11/2009 |
| JP | 2010-133034 | 6/2010 |
| WO | WO 2010/007919 | 1/2010 |

OTHER PUBLICATIONS

International Search Report for International PCT Application No. PCT/JP2011/070239 mailed Dec. 6, 2011.

* cited by examiner

*Primary Examiner* — Mark Halpern
(74) *Attorney, Agent, or Firm* — RatnerPrestia

(57) ABSTRACT

A nonwoven fabric suitable for electrical insulation or as a battery separator is provided. The nonwoven fabric includes a PPS fiber, the nonwoven fabric being obtainable by a process for papermaking and having a front surface with a water contact angle greater than that of a back surface of the nonwoven fabric by 5° or more. A suitable method for producing the nonwoven fabric includes dispersing an undrawn polyphenylene sulfide fiber in water, depositing the fiber to form paper, and performing heat and pressure treatment with a calender having two rolls with surface temperatures different by 10° C. or more.

8 Claims, No Drawings

NONWOVEN FABRIC COMPRISING POLYPHENYLENE SULFIDE FIBER

This application is a 371 of PCT/JP2011/070239 filed 6 Sep. 2011.

CROSS REFERENCE TO RELATED APPLICATIONS

This application is the U.S. National Phase application of PCT International Application No. PCT/JP2011/070239, filed Sep. 6, 2011, and claims priority to Japanese Patent Application No. 2010-199559, filed Sep. 7, 2010, the disclosures of each application being incorporated herein by reference in their entireties for all purposes.

FIELD OF THE INVENTION

The present invention relates to a nonwoven fabric comprising a polyphenylene sulfide fiber and a method for producing the same, and in particular, to a nonwoven fabric suitable for electrical insulation or as a battery separator and a method for producing the same.

BACKGROUND OF THE INVENTION

Polyphenylene sulfide fibers (hereinafter may be referred to as PPS fibers) are excellent in heat resistance and chemical resistance and their application as high-function fibers has increasingly expanded. Specific application thereof include filters used for collecting dusts in high temperature gas, dryer fabric (canvas) in a drying step for industrial products, and roll wiping materials for office copy machines. The area of their application will be further expanded.

PPS fiber paper, inter alia, has been adopted as roll wiping materials for office copy machines. Such copy machines adopting PPS fiber paper as roll wiping materials are increasing because PPS fiber paper is excellent in lightness and flexibility, which are typical characteristics of paper, and in wiping performance. It has been reported that the use of a fiber having crimps as a PPS fiber could produce PPS fiber paper which has a high sheet strength even with a low mass per unit area and which was also dense and uniform (see Patent Literature 1). Patent Literature 1 proposes specific application of PPS fiber paper to heat-resistant electrical insulation materials, battery separators, and the like.

In recent years, the energy densities of secondary batteries represented by nickel-hydrogen batteries and lithium ion batteries have dramatically increased. Further, for on-vehicle battery application, such batteries with higher capacities have been rapidly developed.

Electrical insulation materials used in batteries, motors, inverters, and the like have been under heavy demand in terms of their performance. For example, a motor insulation material for insulating a winding from a stator or a rotor is sometimes impregnated with a resin varnish in order to further increase its insulation performance. Thus an insulation material sheet subjected to impregnation with a varnish is required to have an excellent property of allowing impregnation with a varnish solution. Further, a secondary battery having a high energy density is exposed to a high temperature environment, and consequently dew condensation may occur due to the humidity in the air. In order to prevent reduction in secondary battery performance due to dew condensation, an insulation material used for the battery is required to exhibit a stable moisture proof effect that does not allow moisture from dew condensation to penetrate through the insulation material.

That is, electrical insulation materials are required to have two properties: an excellent property of allowing impregnation with a varnish solution and a property of preventing moisture penetration. Further, other properties required for electrical insulation materials include a property of dissipating heat in order to allow heat generated from a coil winding to easily dissipate in the atmosphere, thereby suppressing an increase in the temperature of an instrument that is being used.

As described above, motor insulation materials are required to have a property of allowing impregnation with a varnish, a property of preventing moisture penetration, a property of dissipating heat, and the like. Patent Literature 1 discloses that a wet-laid nonwoven fabric made of a PPS fiber (a nonwoven fabric obtainable by a process for papermaking) may comprise a binder and that the wet-laid nonwoven fabric is run through a calender to be heated and pressed. However, the invention described in Patent Literature 1 fails to offer a sufficient solution to the above demands and problems, in particular, a solution to provide a wet-laid nonwoven fabric (a nonwoven fabric obtainable by a process for papermaking) with an excellent property of allowing impregnation with a varnish solution and a property of preventing moisture penetration thereinto.

Another proposed technology suitable for a highly heat-resistant electrical insulation sheet is a heat-resistant nonwoven fabric produced by blending a heat-resistant fiber and an undrawn polyphenylene sulfide fiber (see Patent Literature 2). In Patent Literature 2, the undrawn polyphenylene sulfide fiber in a blending ratio of less than 8% is subjected to thermal fusion bonding. As a result of that, the density of the heat-resistant nonwoven fabric is prevented from becoming too high and the resulting paper is prevented from becoming too smooth and too thin like a sheet, which in turn improves a property of allowing impregnation with a varnish. The invention described in Patent Literature 2 is obtainable by carding a short PPS fiber to form a web and thermally fusion bonding it under a pressure of lower than 100 kg/cm, which pressure is predetermined to prevent the density of the heat-resistant nonwoven fabric from becoming too high. The nonwoven fabric obtainable by the method described in Patent Literature 2 has an excellent property of allowing impregnation with a varnish but fails to provide a complete solution for maintaining a property of allowing impregnation with a varnish while preventing moisture penetration. Further, Patent Literature 2 discloses that the nonwoven fabric is obtainable by a dry method such as a carding method or an air-laid method and that the density of the fabric is preferably not too high. However, in a carding method or an air-laid method, a crimped short fiber having a fiber length of 38 mm or more is usually used for producing a nonwoven fabric, and consequently an obtained web is bulky and the dispersion state of the fiber is inferior to that in a nonwoven fabric obtainable by a process for papermaking. Therefore, unlike a nonwoven fabric obtainable by a process for papermaking of the present invention, the nonwoven fabric disclosed in Patent Literature 2 lacks the uniformity of the formation and thinness and thus fails to provide a solution for achieving both of an excellent property of allowing impregnation with a varnish and a property of controlling moisture penetration as well as a solution for achieving lightness required for an electrical insulation material.

Known another technology is a printing paper obtainable by a wet method (see Patent Literature 3). Patent Literature 3 discloses that application of moisture to paper during calendering treatment following papermaking using pulp increases the degrees of opacity, white glossiness, and smoothness of the paper. Specifically, the calendering treatment is performed on both surfaces of a nonwoven fabric using a hot soft nip calender preferably having 6 or more nips.

Further, a PPS fiber nonwoven fabric obtainable by a hitherto known process for papermaking has lightness and flexibility, which are typical characteristics of paper, and heat resistance; however, it lacks an excellent property of allowing impregnation with a varnish, which property is required for an electrical insulation material, and excellent dimensional stability in a high temperature environment such as moist heat or dry heat.

PATENT LITERATURE

Patent Literature 1: JP-H9-67786 A
Patent Literature 2: JP-H3-137260 A
Patent Literature 3: JP-2008-274518 A

SUMMARY OF THE INVENTION

The present invention aims to provide a nonwoven fabric comprising a PPS fiber and having an excellent property of allowing impregnation with a varnish. The present invention also aims to provide a nonwoven fabric also having excellent dimensional stability in a high temperature and high humidity environment, when such property is required.

A nonwoven fabric of an embodiment of the present invention is a nonwoven fabric comprising a PPS fiber, the nonwoven fabric being obtainable by a process for papermaking and having a front surface with a water contact angle greater than that of a back surface of the nonwoven fabric by 5° or more.

According to a preferable embodiment of the nonwoven fabric of the present invention, both of the front and back surfaces of the nonwoven fabric have a contact angle in the range of 70° to 110°.

According to another preferable embodiment of the nonwoven fabric of the present invention, the PPS fiber comprises an undrawn PPS fiber, the undrawn PPS fiber is fusion-bonded to form the nonwoven fabric, and the fusion bonding occurs selectively on the front surface of the nonwoven fabric.

The present invention discloses a method for producing a nonwoven fabric, and the method is suitable for producing any of the above nonwoven fabrics. That is, any of the above nonwoven fabrics is produced by a method comprising dispersing an undrawn PPS fiber in water, depositing the fiber on a wire (papermaking net), removing moisture by drying, and performing heat and pressure treatment with a calender having two rolls with surface temperatures different by 10° C. or more.

The present invention can provide a nonwoven fabric having both of a property of allowing impregnation with a varnish and dimensional stability in a high temperature environment. The PPS fiber comprises an undrawn PPS fiber, the undrawn PPS fiber is fusion-bonded to form the nonwoven fabric, and the fusion bonding occurs selectively on the front surface of the nonwoven fabric. The nonwoven fabric obtained in this manner exhibits an excellent property of allowing impregnation with a varnish, excellent dimensional stability in a high temperature environment, and high insulation performance.

DESCRIPTION OF EMBODIMENTS OF THE INVENTION

The inventors have found out that when a nonwoven fabric obtained by a process for papermaking using a PPS fiber has a front surface with a contact angle greater than that of a back surface by 5° or more, the nonwoven fabric has an excellent property of allowing impregnation with a varnish and dimensional change thereof at a high temperature can be reduced. Further, the inventors focused on the problem that dimensional change of an insulation material occurs due to dew condensation phenomenon in high humidity conditions, for example, in the case of a pump motor, and have found out that such dimensional change in a high temperature and high humidity environment can be prevented when the front and back surfaces of the nonwoven fabric has a contact angle in the range of 70° to 110°. The inventors have thus completed the present invention.

The contact angle defined in the present invention is a contact angle with water and measured by a method complied with JIS R 3257 (1999) "6. Sessile Drop Method". The above-described condition in which the front surface of the nonwoven fabric has a contact angle greater than that of the back surface by 5° or more is understood to mean that the front surface has a greater degree of droplet repellency than the back surface. A front surface is defined as a surface with a greater contact angle. When the nonwoven fabric is used as an electrical insulation material, the nonwoven fabric is disposed between a winding and a stator with the front surface facing the winding, thereby preventing dew condensation from occurring on the winding side. In this way, the winding is protected from deterioration. In addition, since the nonwoven fabric's back surface that faces the stator is selectively given an excellent property of allowing impregnation with a varnish, the nonwoven fabric can exhibit improved insulation strength and thermal dissipation property. In the present invention, preferably the front surface of the nonwoven fabric has a contact angle greater than that of the back surface of the nonwoven fabric by 9° or more.

Preferably both of the front and back surfaces of the nonwoven fabric of the present invention have a contact angle in the range of 70° to 110°, more preferably in the range of 70° to 100°. The nonwoven fabric having the surfaces with a contact angle of 70° or more can easily repel moisture (water droplets), especially moisture in the air, and exhibit excellent dimensional stability in a high humidity and high temperature environment. The nonwoven fabric having the surfaces with a contact angle not more than the upper limit of the above range is preferable because it can exhibit an excellent property of allowing impregnation with a varnish, especially, a water-based varnish. Further, the nonwoven fabric having the surfaces with a contact angle in the range of 80° to 100° is more preferable because it suffers less deterioration due to attachment of water droplets and can exhibit a sufficient property of allowing impregnation with a varnish. Since the front surface of the nonwoven fabric has a water contact angle greater than that of the back surface by 5° or more, the contact angle of the front surface is preferably in the range of 75° to 110°, more preferably in the range of 75° to 100°. The contact angle of the back surface is preferably in the range of 70° to 105°, more preferably in the range of 70° to 95°.

The front surface of the nonwoven fabric herein refers to a nonwoven fabric's constituent surface that has a greater contact angle. The back surface of the nonwoven fabric refers to the other surface. The nonwoven fabric of the present invention is obtainable by a process for papermaking. In a process for papermaking, fibers as a raw material are dispersed in water; a papermaking raw solution to which a dispersing agent, a defoaming agent, or the like is added as necessary is prepared; and the papermaking raw solution is fed to a papermaking machine to form paper. Any papermaking machine with a conventional structure can be used without any problems. The papermaking machine may be any of cylinder papermaking machines, Fourdrinier papermaking machines, and short-wire papermaking machines. After the obtained wet paper is placed on a belt, water is squeezed out from the paper and dried, and the paper is then rolled up to give a nonwoven fabric.

The PPS fiber used in an embodiment of the present invention is a synthetic fiber made of a polymer whose major structural unit is the following structure unit:

$$—(C_6H_4—S)—$$

Examples of such a PPS polymer include polyphenylene sulfide, polyphenylene sulfide sulfone, polyphenylene sulfide ketone, random copolymers thereof, block copolymers thereof, and mixtures thereof. A particularly preferred PPS polymer is polyphenylene sulfide containing a p-phenylene unit represented by—$(C_6H_4—S)$—as its major polymer structural unit, preferably in an amount of 90 mol % or more. When expressed in mass, the p-phenylene unit contained in polyphenylene sulfide is preferably 80% by mass, more preferably 90% by mass or more. Since the PPS fiber used in the present invention is subjected to a process for papermaking, the fiber length is preferably in a range of 2 to 38 mm. The fiber having a length in the range of 2 to 38 mm can be uniformly dispersed in a papermaking raw solution and such fiber has sufficient tensile strength to undergo a drying step while in a wet state (in a state of wet paper) immediately after a paper forming step. The thickness of the PPS fiber expressed in a single fiber fineness is preferably in the range of 0.1 to 10 dtex because the PPS fiber with a single fiber fineness in this range can be uniformly dispersed in a papermaking raw solution without aggregation.

The PPS fiber used in the present invention is preferably produced by a method in which a polymer having the above phenylene sulfide structural unit is melted at a temperature above the melting point and spun from a spinning nozzle to give a fiber. The spun fiber as it is obtained is an undrawn PPS fiber. The undrawn PPS fiber is mostly amorphous and thus can serve as a binder for bonding fibers to one another under the application of heat. The undrawn PPS fiber, however, has poor dimensional stability under heat. Therefore, after being spun, such undrawn fibers are oriented by hot-drawing to give a drawn yarn having improved fiber strength and improved thermal dimensional stability. Such a drawn yarn is marketed. Various PPS fibers on the market are, for example, "TORCON" (registered trademark) (manufactured by TORAY) and "PROCON" (registered trademark) (manufactured by Toyo Boseki).

The nonwoven fabric of the present invention preferably has a mass per unit area of 10 to 800 g/m$^2$ and a thickness of 10 to 800 μm, and the mass per unit area and the thickness are selected as appropriate depending on its required insulation performance. In particular, in the case of a motor insulation material, since the nonwoven fabric is inserted between a winding and a stator or a rotor, a moderate flexibility may be required. In this case, preferably the mass per unit area is in the range of 40 to 300 g/m$^2$ and the thickness is 40 to 300 μm. The thickness is more preferably 40 to 230 μm. The nonwoven fabric with a mass per unit area of 40 g/m$^2$ or more has sufficient insulation performance, and the nonwoven fabric with a mass per unit area of 300 g/m$^2$ or less has sufficient flexibility for incorporation into a motor.

The nonwoven fabric of the present invention is a nonwoven fabric comprising a PPS fiber, as described above. Preferably the PPS fiber comprises an undrawn PPS fiber, the undrawn PPS fiber is fusion-bonded to form the nonwoven fabric, and more fusion bonding occurs on the front surface of the nonwoven fabric. This embodiment is preferable because by heating the PPS fiber comprising the undrawn PPS fiber, the nonwoven fabric's constituent fibers are fixed to each other, which results in increase in the tensile breaking strength of the nonwoven fabric. The fusion bonding is generally performed by heating and pressing the nonwoven fabric with two smooth surface rolls. When undrawn PPS fibers are fusion bonded to form a nonwoven fabric as in an embodiment of the present invention, the fibrous forms of some of the PPS fibers are changed into smooth forms, which makes it easier for the nonwoven fabric to repel water. As a result of that, performance reduction due to dew condensation hardly occurs and dimensional change due to moisture absorption is reduced. Especially in the present invention, as described later, heating and pressing treatment is preferably performed using two smooth surface rolls with surface temperatures set to be different by 10° C. or more, and consequently more fusion bonding occurs selectively on the front surface of the nonwoven fabric. This embodiment is preferable because whereas the front surface is selectively given a property of easily repelling water, the back surface of the nonwoven fabric becomes more hydrophilic with water than the front surface of the nonwoven fabric, thereby exhibiting a property of allowing impregnation with a varnish. Instead of undrawn PPS yarns, a low-melting point polyester component may be used; however, undrawn PPS yarns are preferable as a component to be subjected to thermal fusion bonding because undrawn PPS yarns can be selectively thermally fusion-bonded at a lower heating and pressing temperature than a low-melting point polyester component.

In cases where fusion bonding on the front and back surfaces of the nonwoven fabric occurs to a similar extent, it becomes difficult to simultaneously achieve prevention of dew condensation on the nonwoven fabric due to moisture in the atmosphere and possession of a property of allowing impregnation with a varnish. Therefore, preferably more fusion bonding occurs on the front surface of the nonwoven fabric and less fusion bonding occurs on the back surface of the nonwoven fabric.

The nonwoven fabric of the present invention can prevent dew condensation due to moisture in the atmosphere and has excellent property of allowing impregnation with a varnish. When the nonwoven fabric of the present invention is used in electrical insulation applications, the nonwoven fabric can improve insulation strength and provide thermal dissipation property. Therefore, the nonwoven fabric of the present invention can be suitably used in electrical insulation applications.

A material obtained by impregnating the nonwoven fabric of the present invention with a varnish has a high electrical breakdown voltage and excellent dimensional stability under heat and humidity and thus can be suitably used as an electrical insulation material. The varnish used herein may be made of various types of thermosetting resins and thermoplastic resins, such as epoxy resins, phenol resins, polyimides, and polyamide-imide resins.

The nonwoven fabric of the present invention can be produced by, for example, the following method. A material comprising undrawn PPS fibers is dispersed in water, disposed on a wire (a papermaking net) to form a paper, and dried to remove moisture (the steps up to here included in a process for papermaking). Then, heating and pressing treatment is performed with a calender. The calender has two rolls with surface temperatures set to be different by 10° C. or more.

When the undrawn PPS fibers are dispersed in water, drawn PPS fiber yarns may be added, and as necessary a dispersing agent, a defoaming agent, or the like may be added to uniformly disperse the PPS fibers. The addition of drawn PPS fiber yarns is preferable because it improves the tensile strength of an obtained nonwoven fabric. However, if the amount of the undrawn PPS fibers is too small, fusion bonding may insufficiently occur under heating and pressing treatment with a calender and thus the effect of preventing dew condensation may be reduced. Therefore, the amount of the undrawn PPS fibers to be used is preferably 20% by mass or more relative to the total amount of the nonwoven fabric. Further, when the nonwoven fabric is used in electrical insulation applications, for the purpose of achieving both of prevention of dew condensation and possession of a property of allowing impregnation with a varnish, the amount of the undrawn PPS fibers is more preferably 30% to 70% by mass relative to the total amount of the nonwoven fabric.

Disposition on a wire to form a paper and moisture removal by drying can be performed with a papermaking machine and its dryer part. In the dryer part, the following steps may be performed: a wet paper formed with a papermaking machine in the previous step is transferred to a belt, the paper is squeezed between two belts to remove water, and the resultant paper is dried using a rotary drum. The drying temperature with the rotary drum is preferably 90 to 120° C. At this temperature, water can be efficiently removed and amorphous components contained in the undrawn PPS fibers can remain without being softened, and consequently fusion bonding sufficiently occurs with a calender in the following step.

In a preferable production method for the nonwoven fabric of the present invention, heating and pressing treatment with a calender after removal of moisture by drying is performed using a calender having two rolls with surface temperatures set to be different by 10° C. or more. Any calender may be used as long as it includes one or more pairs of two rolls having a heating and pressing means. The rolls may be made of a material appropriately selected from metals, paper, rubbers, or the like. Among these, a roll made of a metal such as iron is suitably used for the purpose of reducing fine fluff on the surfaces of the nonwoven fabric. In another preferable embodiment of a pair of two rolls, one roll is made of a metal and the other is made of a paper. This embodiment is preferable because by setting the surface temperatures so that the metal roll has a higher temperature and the paper roll has a lower temperature, the conditions of the front and back surfaces of the nonwoven fabric can be made more distinctively different. In particular, by employing a paper roll and setting the surface temperature at a lower temperature, voids between the fibers will remain, which contributes to high compatibility with water or a varnish and consequently to an excellent property of allowing impregnation with a varnish. Further, when a paper roll is used, occurrence of wrinkles in the width direction of the obtained nonwoven fabric can be reduced and therefore unevenness in thickness hardly occurs, as compared with the case where only metal rolls are used.

Heating and pressing treatment using two rolls with surface temperatures set to be different by 10° C. or more can provide the features of the present invention to the front and back surfaces. On the nonwoven fabric surface treated with the roll having a higher surface temperature, more fusion bonding occurs and thus the surface can be smoothed. The fusion bonding and the smoothed surface make it easier for the nonwoven fabric to repel water and can increase the tensile strength of the entire nonwoven fabric. On the nonwoven fabric surface treated with the roll having a lower surface temperature, the voids remaining between the fibers contribute to high compatibility with water or a varnish and consequently to an excellent property of allowing impregnation with a varnish. Preferably the temperatures of two metal rolls used for the treatment are set in the range of 150 to 190° C. for one roll and in the range of 190 to 220° C. for the other roll so that the temperatures are different by 10° C. or more, thereby producing an nonwoven fabric distinctively having both of dimensional stability under heat and humidity and a property of allowing impregnation with a varnish.

In cases where the two rolls are a paper roll and a metal roll, preferably the temperatures of the two rolls are set in the range of 150 to 190° C. for the metal roll and in the range of 105 to 130° C. for the paper roll so that the temperatures are different by 20° C. or more. With the use of the rolls having these different temperatures, heating and pressing treatment can be performed without any problems, and an obtained nonwoven fabric is excellent in both of dimensional stability under heat and humidity and a property of allowing impregnation with a varnish. More preferably, the surface temperatures of the two rolls are different by 15° C. or more. With the use of the two rolls having these different temperatures, both of excellent dimensional stability with respect to moisture absorption and excellent water absorbing property can be achieved. The pressure between the rolls is preferably in a linear pressure range of 100 to 8,000 N/cm. By performing the treatment with the linear pressure of 100 to 8,000 N/cm, undrawn PPS fibers are sufficiently fusion-bonded, thereby producing an nonwoven fabric exhibiting strength and having two properties, a property of preventing dew condensation and a property of allowing impregnation with a varnish.

EXAMPLES

Next, the present invention will be described in further detail using Examples. However, the present invention is not limited by these Examples.

Measurement and Evaluation Method (1) Mass Per Unit Area

In accordance with JIS L 1913 (2010), three test pieces (25 cm×25 cm) were taken, the mass (g) of each test piece was measured in the standard condition (20° C.±2° C., 65±4% RH) and expressed in mass per $m^2$ ($g/m^2$).

(2) Thickness

In accordance with JIS L 1096 (1999) which is applied mutatis mutandis to JIS L 1906 (2000), pressure of 2 kPa was applied to 10 different positions of each sample with a presser having a diameter of 22 mm, 10 seconds were allowed to pass so that the thickness becomes stable, the thickness was measured for each position with a thickness measurement apparatus, and the mean value thereof was calculated.

(3) Contact Angle

Contact angle measurement was performed in an environment of 20° C. and 65% RH in accordance with "6. Sessile Drop Method" of JIS R 3257 (1999). One test piece (8 cm×3.5 cm) was taken and attached to a slide glass using a double-sided tape. With the use of a syringe having a needle of type 22G, 2.0 μL of a droplet was placed thereon. For making a droplet, a load time of 400 ms and a load voltage of 2000 mV were used. Distilled water was used to produce a droplet. The contact angle was measured 1 second after the droplet was placed on the test piece. The contact angle was measured with DropMaster 700 (Kyowa Interface Science Co., Ltd.). The results were analyzed by the θ/2 method using FAMAS contact angle measurement "Sessile Drop Method" add-in software (Kyowa Interface Science Co., Ltd.) and the mean value of measurement at 10 positions was calculated.

(4) Property of Allowing Impregnation with Varnish

Two test pieces (5 cm×5 cm) were taken. As a varnish, a polyamide-imide resin, "VYLOMAX" HR-11NN (Toyo Boseki) was used. Each test piece was immersed into the varnish in a plastic vat at room temperature for 30 seconds and then lightly squeezed. The test piece was dried at 150° C. for 20 minutes with a hot air dryer and then its mass was measured. The amount of the impregnated varnish was calculated by the following formulae.

Amount of impregnated varnish ($g/m^2$)=(Mass after drying−Mass before impregnation)/0.0025

Amount of impregnated varnish (%)=(Amount of impregnated varnish ($g/m^2$)/Mass per unit area of nonwoven fabric after calendering ($g/m^2$)×100

(5) Electrical Breakdown Voltage

Using two test pieces (5 cm×5 cm) impregnated with the varnish, measurement was performed in accordance with JIS K 6911 (1995). Each test piece was sandwiched by disk-shaped electrodes 25 mm in diameter and 250 g in mass. An alternating voltage with a frequency of 60 Hz was applied in the air as the test medium, increasing at a rate of 0.25 kV/second. The voltage at which electrical breakdown occurred was measured. The measurement was performed with an electrical breakdown voltage tester (Yasuda Seiki Seisakusho LTD.).

(6) Dimensional Stability Under Heat and Humidity

Five test pieces (20 cm×20 cm) not impregnated with the varnish were taken and left to stand in a desiccator in a room at a temperature of 20° C. and a humidity of 65% RH for 24 hours. Then, each test piece was left to stand for 6 hours in a constant temperature and humidity room in which the temperature and humidity were adjusted to 25° C. and 80% RH, respectively. The dimensions of each test piece were measured and the shrinkage percentage in the length and the width was calculated by the following formula. The constant temperature and humidity room was the one manufactured by TABAI ESPEC Corp.

Shrinkage percentage (%)=(Length before test−Length after test)/(Length before test)×100

(Undrawn PPS Fiber Yarn)

As an undrawn PPS fiber, "TORCON" (registered trademark) (product number: S111, TORAY) having a single fiber fineness of 3.0 dtex (diameter: 17 μm) and a cut length of 6 mm was used.

(Drawn PPS Fiber Yarn)

As a drawn PPS fiber, "TORCON" (registered trademark) (product number: S301, TORAY) having a single fiber fineness of 1.0 dtex (diameter: 10 μm) and a cut length of 6 mm was used.

(Drawn Polyester Fiber Yarn)

As a drawn polyester fiber, "TETRON" (registered trademark) (product number: T9615, TORAY) having a single fiber fineness of 2.2 dtex (diameter: 14 μm) and being cut into 6 mm pieces was used.

(Drawn Para-Aramid Fiber Yarn)

As a drawn para-aramid fiber, "KEVLAR" (registered trademark) (DU PONT-TORAY Co., Ltd.) having a single fiber fineness of 1.7 dtex (diameter: 12 μm) and a cut length of 6 mm was used.

(Manual Papermaking Machine)

A manual papermaking machine (manufactured by KUMAGAI RIKI KOGYO Co., Ltd.) having a size of 25 cm×25 cm and a height of 40 cm and being equipped with a 140-mesh manual papermaking net on the bottom was used.

(Rotary Dryer)

For drying of manually produced paper, a rotary dryer (ROTARY DRYER DR-200, KUMAGAI RIKI KOGYO Co., Ltd.) was used.

(Heating and Pressing Step)

A heating and pressing step was performed using a hydraulic three roll calender having an iron roll and a paper roll (model type: IH H3RCM, YURI ROLL Co., Ltd.).

Example 1

The undrawn PPS fiber yarn and the drawn PPS fiber yarn were provided in such amounts as to satisfy the mass ratio shown in Table 1, and they were dispersed in water to give a dispersion liquid. Wet paper was produced from the dispersion liquid with the manual papermaking machine. The wet paper was heated and dried at 110° C. for 70 seconds with the rotary dryer. Next, the temperatures of the iron roll and the paper roll were set to be different by 45° C. as shown in Table 1. The paper was then heated and pressed twice with the same surface being on the iron roll side under conditions of at a linear pressure of 490 N/cm and a roll rotation speed of 5 m/minute to give a nonwoven fabric. The obtained nonwoven fabric had excellent dimensional stability under heat and humidity and a sufficient property of allowing impregnation with a varnish.

Further, the sample that was impregnated with the varnish had a high electrical breakdown voltage and thus had excellent properties as an insulation material.

Example 2

The undrawn PPS fiber yarn and the drawn PPS fiber yarn were provided in such amounts as to satisfy the mass ratio shown in Table 1, and they were dispersed in water to give a dispersion liquid. Wet paper was produced from the dispersion liquid with the manual papermaking machine. The wet paper was heated and dried at 110° C. for 70 seconds with the rotary dryer. Next, the temperatures of the iron roll and the paper roll were set to be different by 55° C. as shown in Table 1. The paper was then heated and pressed twice with the same surface being on the iron roll side under conditions of at a linear pressure of 490 N/cm and a roll rotation speed of 5 m/minute to give a nonwoven fabric. The obtained nonwoven fabric had excellent dimensional stability under heat and humidity and, as with the nonwoven fabric in Example 1, had an excellent property of allowing impregnation with a varnish.

Reference Example 1

The drawn polyester fiber yarn and the drawn PPS fiber yarn were provided in such amounts as to satisfy the mass ratio shown in Table 1, and they were dispersed in water to give a dispersion liquid. Wet paper was produced from the dispersion liquid with the manual papermaking machine. The wet paper was heated and dried at 110° C. for 70 seconds with the rotary dryer. Next, the temperatures of the iron roll and the paper roll were set to be different by 55° C. as shown in Table 1. In an attempt of heating and pressing of the obtained paper under the conditions of at a linear pressure of 490 N/cm and a roll rotation speed of 5 m/minute, the paper adhered to the roll surfaces and a nonwoven fabric in a good condition could not be obtained.

Example 3

In the same manner as in Reference Example, the drawn polyester fiber yarn and the drawn PPS fiber yarn were provided in such amounts as to satisfy the mass ratio shown in Table 1, and they were dispersed in water to give a dispersion liquid. Wet paper was produced from the dispersion liquid with the manual papermaking machine. The wet paper was heated and dried at 110° C. for 70 seconds with the rotary dryer. Next, the temperatures of the iron roll and the paper roll were set to be different by 60° C. as shown in Table 1. The paper was then heated and pressed only once under conditions of at a linear pressure of 490 N/cm and a roll rotation speed of 5 m/minute to give a nonwoven fabric. As with the nonwoven fabric in Example 2, the obtained nonwoven fabric had a sufficient property of allowing impregnation with a varnish. The electrical breakdown voltage of the nonwoven fabric was lower than that of the nonwoven fabric in Example 1 but was good enough.

Example 4

The undrawn PPS fiber yarn and the drawn PPS fiber yarn were provided in such amounts as to satisfy the mass ratio shown in Table 2, and they were dispersed in water to give a dispersion liquid. Wet paper was produced from the dispersion liquid with the manual papermaking machine. The wet paper was heated and dried at 110° C. for 70 seconds with the rotary dryer. Next, the temperatures of the iron roll and the paper roll were set to be different by 35° C. as shown in Table 1. The paper was then heated and pressed only once under conditions of at a linear pressure of 490 N/cm and a roll rotation speed of 5 m/minute to give a nonwoven fabric. The obtained nonwoven fabric had excellent dimensional stability under heat and humidity and, as with the nonwoven fabric in Example 3, had a excellent property of allowing impregnation with a varnish.

Comparative Example 1

The undrawn PPS fiber yarn and the drawn PPS fiber yarn were provided in such amounts as to satisfy the mass ratio shown in Table 2, and they were dispersed in water to give a dispersion liquid. Wet paper was produced from the dispersion liquid with the manual papermaking machine. The wet paper was heated and dried at 110° C. for 70 seconds with the rotary dryer. Next, the temperatures of the iron roll and the paper roll were set as shown in Table 1. The obtained paper was then heated and pressed twice with the same surface being on the iron roll side under conditions of at a linear pressure of 490 N/cm and a roll rotation speed of 5 m/minute. Due to high calendering temperature, fusion-bonding of the undrawn PPS fiber yarns proceeded on the back surface in the same manner as on the front surface. Thus, the obtained nonwoven fabric had no difference in the surface condition between the front surface and the back surface and had a poor property of allowing impregnation with a varnish. Further, the sample that was impregnated with the varnish also had a low electrical breakdown voltage.

Comparative Example 2

The undrawn PPS fiber yarn and the drawn para-aramid fiber yarn were provided in such amounts as to satisfy the mass ratio shown in Table 2, and they were dispersed in water to give a dispersion liquid. Wet paper was produced from the dispersion liquid with the manual papermaking machine. The wet paper was heated and dried at 110° C. for 70 seconds with the rotary dryer. Next, the temperatures of the iron roll and the paper roll were set as shown in Table 1. The obtained paper was then heated and pressed twice with each surface being once on the iron roll side under conditions of at a linear pressure of 490 N/cm and a roll rotation speed of 5 m/minute to give a nonwoven fabric. On both of the front surface and the back surface of the nonwoven fabric, the undrawn PPS fiber yarns were fusion-bonded to one another, and the nonwoven fabric was thus significantly inferior in a property of allowing impregnation with a varnish and dimensional stability under heat and humidity. The sample that was impregnated with the varnish also had a low electrical breakdown voltage.

Reference Example 2

The undrawn PPS fiber yarn and the drawn PPS fiber yarn were provided in such amounts as to satisfy the mass ratio shown in Table 2, and they were dispersed in water to give a dispersion liquid. Wet paper was produced from the dispersion liquid with the manual papermaking machine. The obtained wet paper was dried in a room without using the rotary dryer to give a nonwoven fabric. The obtained nonwoven fabric had no difference in contact angle between the front surface and the back surface. Further, since the nonwoven fabric had a low strength, it was impossible to subject the nonwoven fabric to impregnation treatment with the varnish.

TABLE 1

| | | Example 1 | Example 2 | Reference Example 1 | Example 3 |
|---|---|---|---|---|---|
| Fiber constituents (wt %) | Undrawn PPS fiber yarn | 50 | 50 | 0 | 0 |
| | Drawn PPS fiber yarn | 50 | 50 | 50 | 50 |
| | Drawn polyester fiber yarn | 0 | 0 | 50 | 50 |
| | Drawn para-aramid fiber yarn | 0 | 0 | 0 | 0 |
| Calendering conditions | Temperature of iron roll (° C.) | 150 | 170 | 170 | 190 |
| | Temperature of paper roll (° C.) | 105 | 115 | 115 | 130 |
| | Number of treatments | Front surface twice × Back surface zero times | Front surface twice × Back surface zero times | Not workable | Front surface once × Back surface zero times |
| Properties of nonwoven fabric | Mass per unit area ($g/m^2$) | 52 | 60 | — | 56 |
| | Thickness (mm) | 0.053 | 0.053 | — | 0.117 |
| | Ø1: Contact angle of front surface (°) | 90 | 95 | — | 118 |
| | Ø2: Contact angle of back surface (°) | 81 | 86 | — | 98 |
| | Ø1 − Ø2 (°) | 9 | 9 | — | 20 |
| | Property of allowing impregnation with varnish ($g/m^2$) | 44 | 40 | — | 40 |
| | Property of allowing impregnation with varnish (%) | 85 | 77 | — | 71 |

TABLE 1-continued

| | | | Example 1 | Example 2 | Reference Example 1 | Example 3 |
|---|---|---|---|---|---|---|
| | Electrical breakdown voltage (kv) | | 2.0 | 1.9 | — | 1.4 |
| | Dimensional stability under heat and humidity (%) | Length | 0.0 | 0.0 | — | 0.0 |
| | | Width | 0.0 | 0.0 | — | 0.0 |

TABLE 2

| | | | Example 4 | Comparative Example 1 | Comparative Example 2 | Reference Example 2 |
|---|---|---|---|---|---|---|
| Fiber constituents (wt %) | Undrawn PPS fiber yarn | | 50 | 50 | 50 | 50 |
| | Drawn PPS fiber yarn | | 50 | 50 | 0 | 50 |
| | Drawn polyester fiber yarn | | 0 | 0 | 0 | 0 |
| | Drawn para-aramid fiber yarn | | 0 | 0 | 50 | 0 |
| Calendering conditions | Temperature of iron roll (° C.) | | 135 | 190 | 150 | N/A |
| | Temperature of paper roll (° C.) | | 100 | 130 | 105 | N/A |
| | Number of treatments | | Front surface once × Back surface zero times | Front surface twice × Back surface zero times | Front surface once × Back surface once | N/A |
| Properties of nonwoven fabric | Mass per unit area (g/m$^2$) | | 43 | 52 | 32 | 38 |
| | Thickness (mm) | | 0.07 | 0.056 | 0.042 | 0.156 |
| | Ø1: Contact angle of front surface (°) | | 100 | 89 | 84 | 112 |
| | Ø2: Contact angle of back surface (°) | | 91 | 87 | 83 | 111 |
| | Ø1 − Ø2 (°) | | 9 | 2 | 1 | 1 |
| | Property of allowing impregnation with varnish | (g/m$^2$) | 41 | 12 | 24 | Not workable |
| | | (%) | 95 | 23 | 75 | Not workable |
| | Electrical breakdown voltage (kv) | | 1.6 | 1.3 | 1.1 | — |
| | Dimensional stability under heat and humidity (%) | Length | 0.0 | 0.0 | 0.4 | — |
| | | Width | 0.0 | 0.0 | 0.5 | — |

As is apparent from Tables 1 and 2, each of the nonwoven fabrics in Examples 1 to 3 had high dimensional stability under heat and humidity and is thus excellent fabric in which no dimensional change due to moisture absorption may occur and which had a sufficient property of allowing impregnation with a varnish and a very suitable electrical breakdown voltage for use as an electrical insulation material. The nonwoven fabric in Example 4 is a paper made only of the PPS fibers and the surfaces had higher absolute values of the contact angle than those of the nonwoven fabric in Examples 1 and 2 having the same constitution and thus can easily repel water. The nonwoven fabric in Example 4 also had an excellent property of allowing impregnation with a varnish. The nonwoven fabric in Reference Example 2 has the same constitution and its contact angles can be improved; however, the strength of the nonwoven fabric was low and therefore it was impossible to subject the nonwoven fabric to impregnation with a varnish.

The invention claimed is:

1. A nonwoven fabric comprising a polyphenylene sulfide fiber, the nonwoven fabric being obtained by a process for papermaking, the polyphenylene sulfide fiber comprising an undrawn polyphenylene sulfide fiber, the amount of the undrawn polyphenylene sulfide being 30% to 70% by mass relative to the total amount of the nonwoven fabric, more fusion bonding occurring on a front side of the nonwoven fabric and less fusion bonding occurring on a back surface of the nonwoven fabric, both of a front and a back surface of the nonwoven fabric having a water contact angle in the range of 70° and 110°, wherein the water contact angle is measured by a method complied with JIS R 3257 (1999) "6. Sessile Drop Method" and having the front surface with the water contact angle greater than that of the back surface of the nonwoven fabric by 5° or more.

2. The nonwoven fabric according to claim 1, wherein the undrawn polyphenylene sulfide fiber is fusion-bonded to form the nonwoven fabric, and the fusion bonding occurs selectively on the front surface of the nonwoven fabric.

3. The nonwoven fabric according to claim 1 or 2, which is used in electrical insulation application.

4. An electrical insulation material using the nonwoven fabric according to claim 1 or 2.

5. A method for producing the nonwoven fabric according to claims 1 or 2, the method comprising dispersing an undrawn polyphenylene sulfide fiber in water, depositing the fiber on a papermaking net, removing moisture by drying, and performing heat and pressure treatment with a calender having two rolls with surface temperatures different by 10° C. or more.

6. The method for producing the nonwoven fabric according to claim 5, wherein the calender has a first roll and a second roll, the first roll having a surface temperature of 105 to 130° C. and the second roll having a surface temperature of 150 to 190° C.

7. The method for producing the nonwoven fabric according to claim 5, wherein the calender has a first roll and a second roll, the first roll being made of a paper and having a surface temperature of 105 to 130° C., the second roll being made of a metal and having a surface temperature of 150 to 190° C.

8. A nonwoven fabric comprising a polyphenylene sulfide fiber, the nonwoven fabric being obtained by a process for papermaking, the nonwoven fabric further comprising polyester fiber, more fusion bonding occurring on a front side of the nonwoven fabric and less fusion bonding occurring on a back surface of the nonwoven fabric, and having a front surface with a water contact angle greater than that of a back surface of the nonwoven fabric by 5° or more, wherein the water contact angle is measured by a method complied with JIS R 3257 (1999) "6. Sessile Drop Method".

* * * * *